US010119752B2

(12) United States Patent
Jeong et al.

(10) Patent No.: US 10,119,752 B2
(45) Date of Patent: Nov. 6, 2018

(54) REFRIGERATOR AND METHOD OF CONTROLLING THE SAME

(71) Applicant: Samsung Electronics Co., Ltd., Suwon-si, Gyeonggi-do (KR)

(72) Inventors: Jin Jeong, Yongin-si (KR); Jae Jin Lee, Suwon-si (KR); Yoon Young Kim, Suwon-si (KR); Bong Su Son, Cheonan-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/352,915

(22) Filed: Nov. 16, 2016

(65) Prior Publication Data

US 2017/0167783 A1 Jun. 15, 2017

(30) Foreign Application Priority Data

Dec. 15, 2015 (KR) ..... 10-2015-0179285

(51) Int. Cl.

| | |
|---|---|
| ***F25D 29/00*** | (2006.01) |
| ***B67D 1/08*** | (2006.01) |
| ***F25D 23/02*** | (2006.01) |
| ***F25D 23/12*** | (2006.01) |

(52) U.S. Cl.

CPC ..... *F25D 29/00* (2013.01); *B67D 1/0882* (2013.01); *B67D 1/0888* (2013.01); *F25D 23/028* (2013.01); *F25D 23/126* (2013.01); *F25D 2400/361* (2013.01); *F25D 2700/00* (2013.01)

(58) Field of Classification Search

CPC ..... B67D 1/0882; B67D 1/0888; F25D 2303/081; F25D 23/028; F25D 2400/361

USPC ..... 141/83, 275; 62/389

See application file for complete search history.

(56) References Cited

U.S. PATENT DOCUMENTS

| | | | | |
|---|---|---|---|---|
| 5,031,673 | A * | 7/1991 | Clusserath | B65B 55/10 141/11 |
| 5,244,020 | A * | 9/1993 | Bruno | G01G 19/56 141/255 |
| 5,490,547 | A * | 2/1996 | Abadi | B67D 3/0009 141/21 |
| 8,109,301 | B1 * | 2/2012 | Denise | F25C 5/005 141/198 |
| 9,057,556 | B2 * | 6/2015 | Ashrafzadeh | B67D 1/001 |

(Continued)

FOREIGN PATENT DOCUMENTS

| | | |
|---|---|---|
| EP | 1930673 A2 | 6/2008 |
| KR | 20-0181893 | 5/2000 |

(Continued)

OTHER PUBLICATIONS

Extended European Search Report dated Apr. 21, 2017 in corresponding European Patent Application No. 16202767.6.

*Primary Examiner* — Timothy L Maust

(74) *Attorney, Agent, or Firm* — Staas & Halsey LLP

(57) ABSTRACT

Disclosed herein are a refrigerator and method of controlling the same. A refrigerator includes an interface unit configured to receive a command for supplying at least one of water and ice from a user; a weight sensor configured to measure a weight of a container placed on a container supporter; and a controller configured to control a supply of the at least one of water and ice based on a change in weight of the container based on the measured weight of the container.

19 Claims, 11 Drawing Sheets

(56) References Cited

U.S. PATENT DOCUMENTS

| | | | | |
|---|---|---|---|---|
| 2005/0268624 | A1 | 12/2005 | Voglewede et al. | |
| 2006/0157152 | A1* | 7/2006 | Wolski | B67D 1/0882 141/275 |
| 2008/0156008 | A1* | 7/2008 | Richmond | F25D 23/126 62/178 |
| 2009/0183796 | A1* | 7/2009 | Chase | B67D 1/001 141/1 |
| 2010/0155415 | A1 | 6/2010 | Ashrafzadeh et al. | |
| 2013/0146179 | A1* | 6/2013 | McMahan | B67D 7/221 141/83 |
| 2016/0290710 | A1* | 10/2016 | Lee | F25D 29/005 |
| 2017/0167783 | A1* | 6/2017 | Jeong | B67D 1/0882 |

FOREIGN PATENT DOCUMENTS

| | | |
|---|---|---|
| KR | 10-2009-0020951 | 2/2009 |
| KR | 10-2009-0038052 | 4/2009 |
| KR | 10-2010-0061110 | 6/2010 |
| WO | 2009/051346 A2 | 4/2009 |

* cited by examiner

REFRIGERATOR AND METHOD OF CONTROLLING THE SAME

CROSS-REFERENCE TO RELATED APPLICATION

This application claims the benefit of Korean Patent Application No. 10-2015-0179285, filed on Dec. 15, 2015 in the Korean Intellectual Property Office, the disclosure of which is incorporated herein by reference.

BACKGROUND

1. Field

The present disclosure relates to a refrigerator with a dispenser embedded therein and a method of controlling the refrigerator.

2. Description of the Related Art

Generally, a refrigerator is a home appliance that includes a storage compartment configured to store food and a cold air supplier configured to supply cold air to the storage compartment to keep the food fresh. These days, a refrigerator is sometimes equipped with a dispenser that allows a user to be provided with water or ice from the outside without opening a door of the refrigerator to fit the user's needs. Accordingly, research is being carried out on a method of supplying a fixed amount of one or more of water and ice through a dispenser.

SUMMARY

Therefore, it is an aspect of the present disclosure to provide a refrigerator of controlling a supply of a fixed amount of at least one of water and ice.

In accordance with one aspect of the present disclosure, a refrigerator includes an interface unit configured to receive a command for supplying at least one of water and ice from a user; a weight sensor configured to measure a weight of a container placed on a container supporter; and a controller configured to control a supply of the at least one of water and ice based on a change in weight of the container based on the measured weight of the container.

Here, the refrigerator further includes a container sensor configured to determine a height of the container placed on the container supporter.

Also, the refrigerator further includes a memory configured to store data related to volume depending on the height of the container.

Also, the controller uses the data related to volume stored in the memory to determine a maximum capacity of the container according to a determined height of the container.

Also, the interface unit receives a supply degree related to the at least one of water and ice.

Also, the controller calculates a supply amount based on a change in weight of the container on the container supporter due to the at least one of water and ice being supplied to the container based on the measured weight of the container, and controls the supply of the at least one of water and ice according to a supply degree received from the user through the interface unit based on the calculated supply amount and the determined maximum capacity.

Also, the controller stops the supply of the at least one of water and ice when the calculated supply amount is equal to the supply degree of the at least one of water and ice received through the interface unit or is equal to the determined maximum capacity.

Also, the controller controls ice to be supplied first when water and the ice are supplied together.

Also, the container sensor detects whether a container is placed on the container supporter using at least one of an optical sensor, a camera, and a micro-switch and determines a height of the container placed on the container supporter when it is detected that the container is placed on the container supporter.

Also, wherein the controller controls a movement of the container supporter so that an outlet configured to discharge the at least one of water and ice and the container placed on the container supporter are spaced apart within a predetermined distance.

Also, the refrigerator further includes an overflow sensor configured to detect whether the at least one of water and ice overflows from the container, Also, the controller controls the supply of at least one of water and ice to stop when the overflow sensor detects that the at least one of water and ice overflows from the container.

In accordance with one aspect of the present disclosure, a method of controlling a refrigerator includes receiving a command for supplying at least one of water and ice from a user; measuring a weight of a container placed on a container supporter; and controlling a supply of the at least one of water and ice based on a change in weight of the container based on the measured weight of the container.

Here, the controlling further comprises determining a height of the container placed on the container supporter.

Also, the controlling further comprises determining a maximum capacity of the container according to the determined height of the container using data related to volume stored in a memory.

Also, wherein the controlling comprises: calculating a supply amount based on a change in weight of the container on the container supporter due to the at least one of water and ice being supplied to the container based on the measured weight of the container; and controlling the supply of the at least one of water and ice according to a supply degree received from the user through an interface unit based on the calculated supply amount and the determined maximum capacity.

Also, the controlling further comprises stopping the supply of the at least one of water and ice when the calculated supply amount is equal to the supply degree of the at least one of water and ice received from the user or is equal to the determined maximum capacity.

Also, the controlling further comprises controlling ice to be supplied first when water and the ice are supplied together.

Also, the controlling further comprises controlling a movement of the container supporter so that an outlet configured to discharge the at least one of water and ice and the container placed on the container supporter are spaced apart within a predetermined distance.

Also, the controlling further comprises: sensing whether the at least one of water and ice overflows from the container through an overflow sensor; and wherein the controller controls the supply to stop when the overflow sensor detects that the at least one of water and ice overflows from the container.

As described above, it is possible to provide a supply of a fixed amount of at least one of water and ice.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
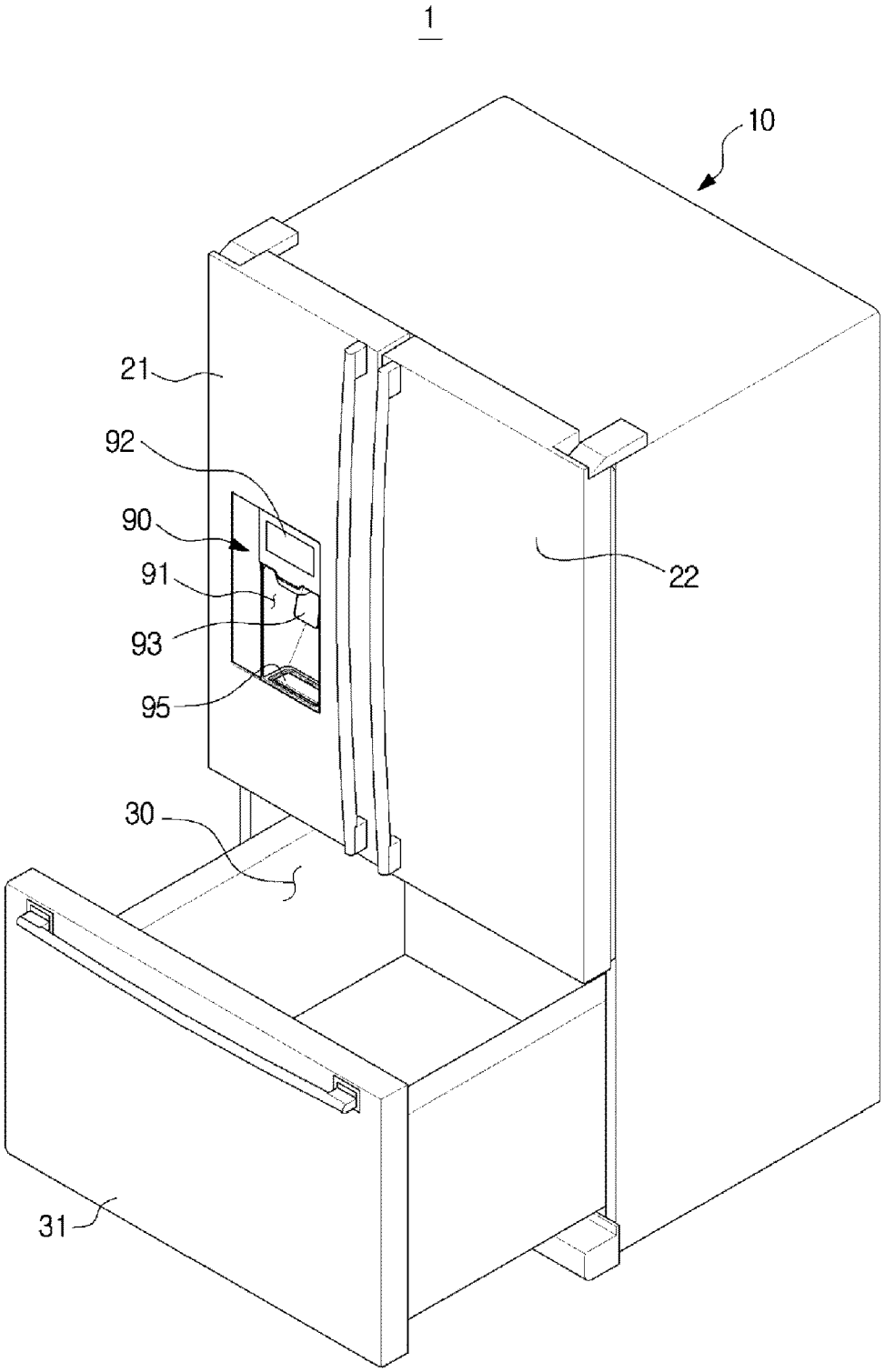
FIG. 1 is a view illustrating an exterior of a refrigerator according to an embodiment.
Figure 2:
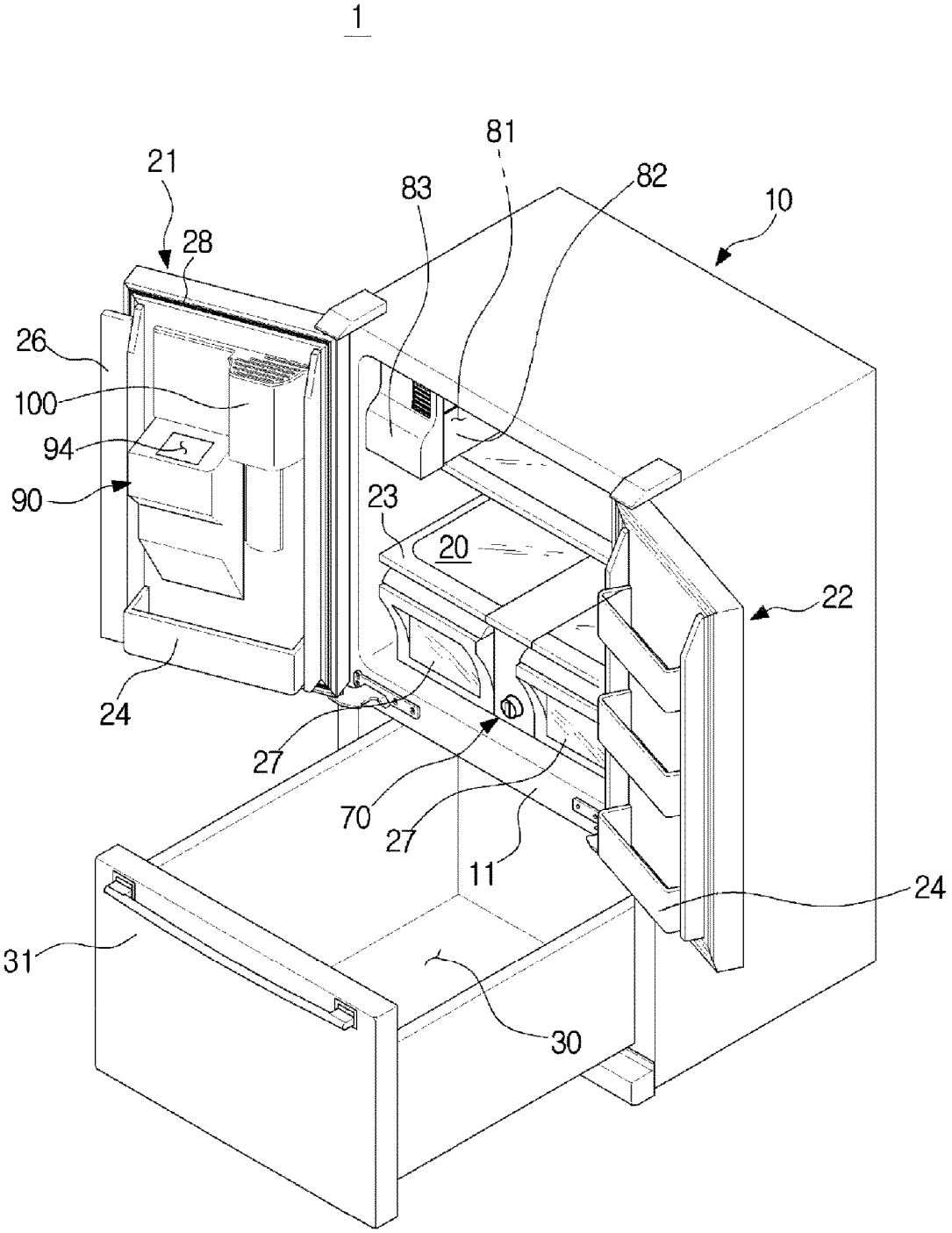
FIG. 2 is a view illustrating an inner portion of the refrigerator according to an embodiment.
Figure 3:
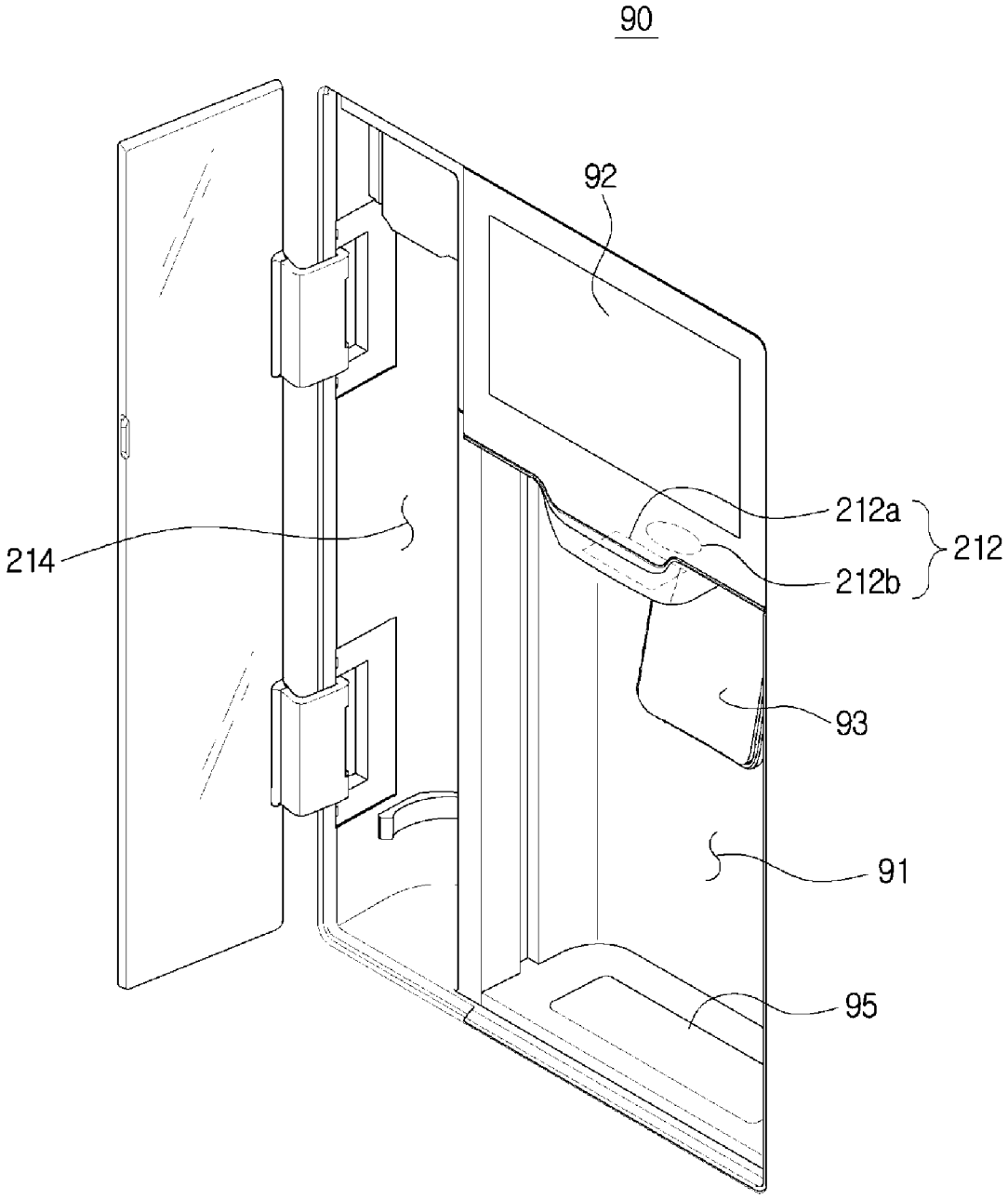
FIG. 3 is an enlarged view of an exterior of a dispenser of the refrigerator according to an embodiment.
Figure 4:
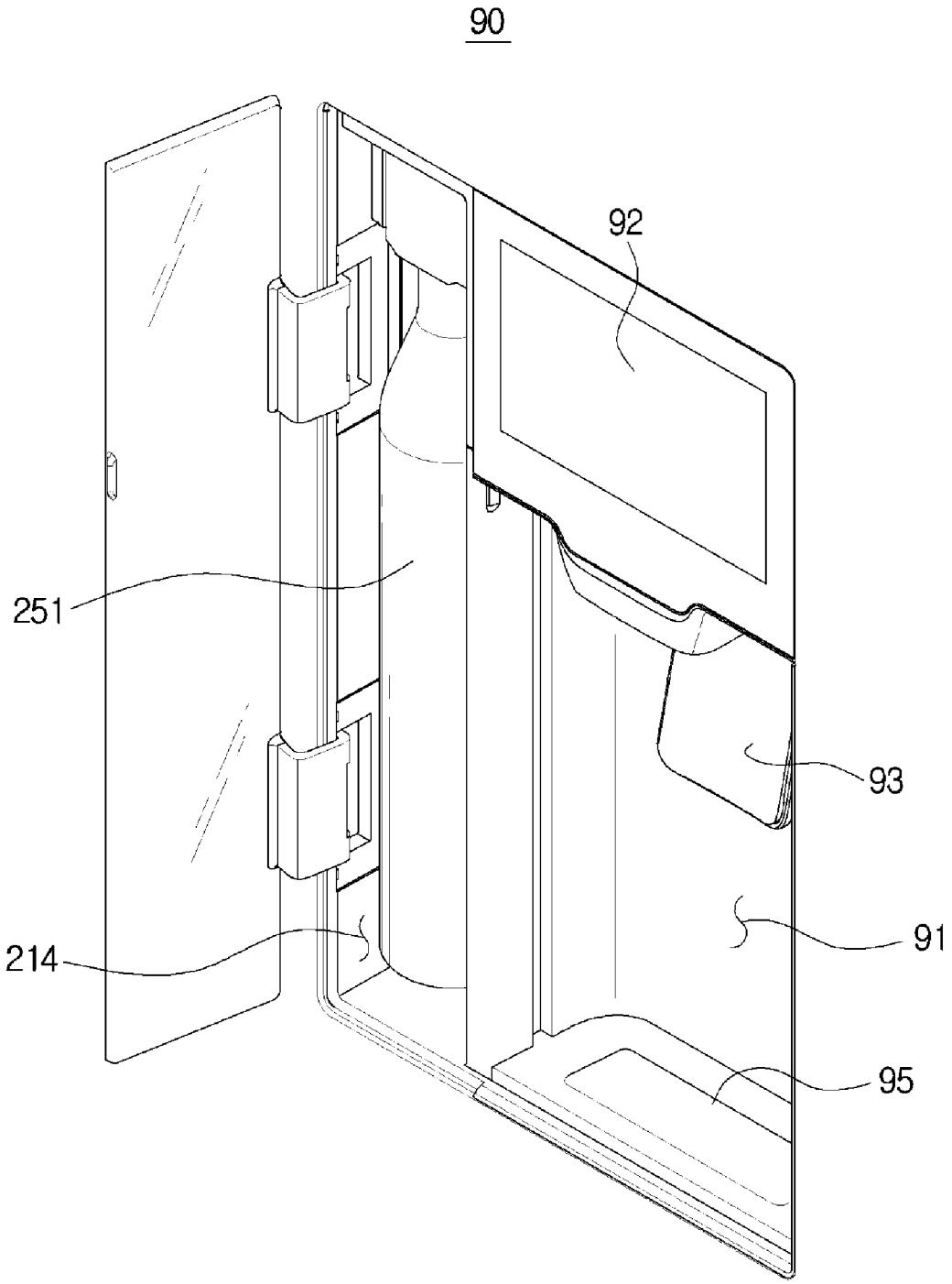
FIG. 4 is an enlarged view of an exterior of a dispenser of the refrigerator according to an embodiment.
Figure 5:
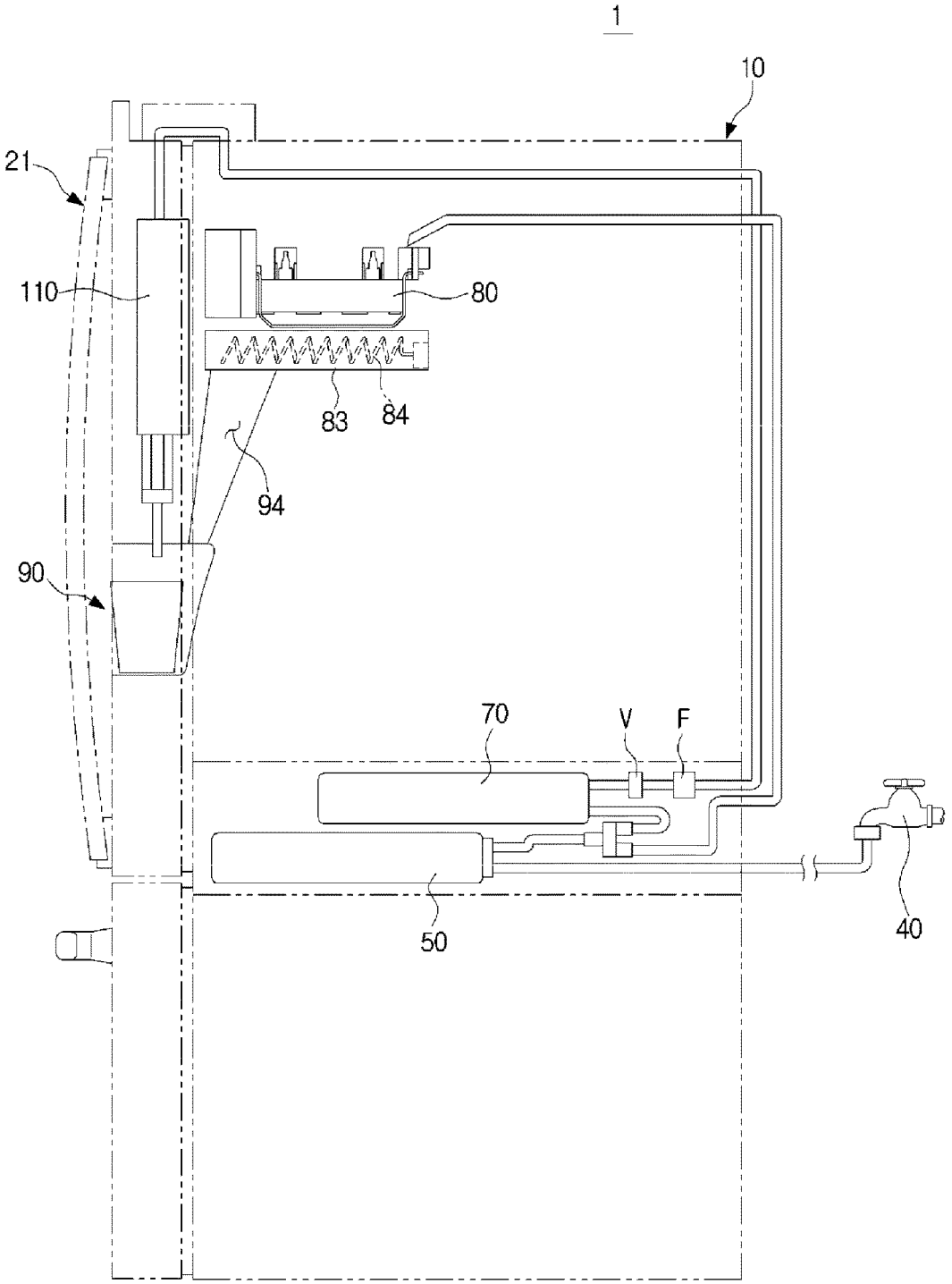
FIG. 5 is a view schematically illustrating a lateral cross-sectional view of the refrigerator according to an embodiment.

FIG. 1 is a view illustrating an exterior of a refrigerator according to an embodiment, and FIG. 2 is a view illustrating an inner portion of the refrigerator according to an embodiment. In addition, FIGS. 3 and 4 are enlarged views of an exterior of a dispenser of the refrigerator according to different embodiments, and FIG. 5 is a view schematically illustrating a lateral cross-sectional view of the refrigerator according to an embodiment. Hereinafter, FIGS. 1 to 5 will be described together to prevent overlapping descriptions.

A refrigerator 1 is an apparatus capable of storing objects at low temperature. More specifically, the refrigerator 1 is an apparatus capable of maintaining a temperature of a storage compartment at a level desired by a user or lower by repeating evaporation and compression of a refrigerant to store the objects at low temperature.

First, an exterior of the refrigerator 1 will be described. As illustrated in FIGS. 1 and 2, the refrigerator 1 includes a main body 10, storage compartments 20 and 30 formed inside the main body 10, and a cooler (not illustrated) configured to supply cold air to the storage compartments 20 and 30. The cooler may include an evaporator, a compressor, a condenser, and an expander so that evaporation and compression of a refrigerant is cyclically performed.

Meanwhile, the main body 10 may include an inner case configured to form the storage compartments 20 and 30, an outer case coupled to an outer portion of the inner case to form the exterior of the refrigerator, and an insulator (not illustrated) disposed between the inner case and the outer case to insulate the storage compartments 20 and 30.

For example, the storage compartments 20 and 30 may be divided into a refrigerator compartment 20 at an upper portion and a freezer compartment 30 at a lower portion by a middle partition 11. Meanwhile, the way in which the storage compartments 20 and 30 are divided is not limited to a horizontally divided form illustrated in FIG. 2, and may have various known forms such as a vertically divided form.

Meanwhile, the refrigerator compartment 20 may be maintained at a temperature of about 3° C. above zero to keep food refrigerated, and the freezer compartment 30 may be maintained at a temperature of about 18.5° C. below zero to keep food frozen. The refrigerator compartment 20 may include a shelf 23 configured to have food placed thereon and one or more storage boxes 27 configured to keep food airtight.

Meanwhile, each of the refrigerator compartment 20 and the freezer compartment 30 may have an open front surface to put in or take out food. The open front surface of the refrigerator compartment 20 may be opened and closed by a pair of rotary doors 21 and 22 coupled to the main body 10 by hinges, and the open front surface of the freezer compartment 30 may be opened and closed by a sliding door 31 that is slidable from the main body 10. A door guard 24 capable of storing food may be provided at each of back surfaces of the refrigerator compartment doors 21 and 22.

Also, a gasket 28 configured to seal a gap between the refrigerator compartment doors 21 and 22 and the main body 10 when the refrigerator compartment doors 21 and 22 are closed to regulate cold air in the refrigerator compartment 20 may be provided at each of edge portions of the back surfaces of the refrigerator compartment doors 21 and 22. Also, a rotary bar 26 configured to seal a gap between the refrigerator compartment door 21 and the refrigerator compartment door 22 when the refrigerator compartment doors 21 and 22 are closed to regulate the cold air in the refrigerator compartment 20 may be provided at any one of the refrigerator compartment doors 21 and 22, e.g., the refrigerator compartment door 21.

Also, an ice compartment 81 configured to produce ice may be formed at a corner of an upper portion of the refrigerator compartment 20 such that the ice compartment 81 is divided from the refrigerator compartment 20 by an ice compartment wall 82.

The refrigerator 1 may include an ice supply module configured to allow ice produced in an ice maker 80 to be discharged to a withdrawal space 91 and control a chute 94 that connects the ice supply module to the withdrawal space 91, and a clean water supply module configured to supply plain water.

Referring to FIG. 5, the ice maker 80 configured to produce plain ice or carbonated ice, an ice bucket 83 configured to store the plain ice or carbonated ice produced by the ice maker 80, and an auger 84 configured to transfer the plain ice or carbonated ice stored in the ice bucket 83 to the chute 94 may be provided in the ice compartment 81. The ice supply module may form ice using the elements described above and may control an operation of discharging the formed ice through the auger 84.

Here, plain ice refers to ice formed by cooling plain water that does not contain carbonation, and carbonated ice refers to ice formed by cooling carbonated water that contains carbonation. Also, plain water refers to water purified by a clean water supply module that will be described below, and carbonated water refers to water containing carbonation. Hereinafter, "water" may be simply used when it is unnecessary to differentiate between plain water and carbonated water, and "ice" may be simply used when it is unnecessary to differentiate between plain ice and carbonated ice.

Meanwhile, a plain water tank 70 configured to store plain water may be provided in the refrigerator compartment 20. Although the plain water tank 70 may be provided between a plurality of storage boxes 27 as illustrated in FIG. 2, a position of the plain water tank 70 is not limited thereto and may be provided at any place inside the refrigerator compartment 20 so that the plain water in the plain water tank 70 can be cooled by cold air inside the refrigerator compartment 20.

The plain water tank 70 may be connected to an external water supply source 40 such as a water pipe as illustrated in FIG. 5 and may store plain water purified by a clean water filter 50. Meanwhile, a water valve V may be provided at a water supply hose connected to the plain water tank 70. Accordingly, the refrigerator 1 according to an embodiment may adjust an opening degree of the water valve V to adjust an amount of water supplied through an outlet 212 after passing through a flow channel. Also, a flow sensor F may be provided at the water supply hose to measure an amount of water being supplied therethrough.

The clean water supply module may supply plain water discharged through the outlet 212 of a dispenser 90 or may supply plain water to a carbonated water supply module to produce carbonated water. The clean water supply module may supply plain water by controlling the plain water tank 70 configured to store purified plain water as illustrated in FIG. 5, a purifying filter 73 configured to purify water supplied from the external water supply source 40, the water valve V configured to adjust an amount of purified plain water being distributed to the ice compartment 81 or the plain water tank 70, and the flow sensor F configured to detect an amount of water being supplied to the ice maker 80 or a carbonated water supply module 110.

Meanwhile, the carbonated water supply module 110 may mix carbon dioxide with plain water and produce carbonated water. As shown in FIGS. 3 and 4, the carbonated water supply module 110 may produce carbonated water through a carbon dioxide gas cylinder 251 accommodated in an accommodation space 214 to store high-pressure carbon dioxide gas and a mixing tank (not illustrated) configured to mix plain water with carbon dioxide gas to produce carbonated water.

Meanwhile, at any one of the refrigerator compartment doors 21 and 22, e.g., the refrigerator compartment door 21, the dispenser 90 configured to allow a user to be provided with water or ice from the outside without opening the refrigerator compartment door 21 may be provided. Although the dispenser 90 may be provided at a front surface of the refrigerator 1 as illustrated in FIG. 1, the dispenser 90 may be provided at any place of the refrigerator 1 as long as the dispenser 90 can visually provide various types of information to the user.

The dispenser 90 may include the withdrawal space 91 configured to have a container inserted therein to receive water or ice, an interface unit 92 configured to display an input button for manipulating various types of settings of the dispenser 90 and various types of information on the dispenser 90, and a lever 93 configured to operate the dispenser 90 so that water or ice is discharged. The dispenser 90 may further include a container supporter 95 configured to support a container which holds water or ice.

The container supporter 95 may be provided by being fixed to a particular position. Alternatively, the container supporter 95 may be movable in vertical and horizontal directions. For example, when a container is placed on the container supporter 95, the refrigerator 1 may control a motor included in the container supporter 95 to move the container supporter 95 to a position near the outlet 212 so that water or ice is prevented from splashing or falling outside the container when discharged. This will be described in detail below.

Also, the container supporter 95 may fix a container disposed on the container supporter 95 to prevent the container from deviating from the container supporter 95. For example, a groove in which the container may be placed may be provided on an upper surface of the container supporter 95 and may be implemented as an elastic member. Accordingly, the user may fix a container by inserting the container into the groove.

Alternatively, the container supporter 95 may include the motor as described above. Accordingly, when it is detected that a container has been placed in the groove on the container supporter 95, the refrigerator 1 may adjust a form of the container supporter 95 using the motor so that the container is fixed in the groove. This will be described in detail below.

Meanwhile, as described above, the interface unit 92 may be provided at the front surface of the refrigerator 1. For example, the interface unit 92 may be implemented using a display. Here, the display may be any one of known various types of displays such as a liquid crystal display (LCD), a light emitting diode (LED) display, a plasma display panel (PDP), an organic LED (OLED) display, and a cathode ray tube (CRT) display but is not limited thereto, and may be any device as long as the device is capable of visually displaying various types of information on the refrigerator 1 and receiving various types of control commands from the user.

The refrigerator 1 according to an embodiment may display a user interface configured to provide various types of information to the user and receive various types of control commands related to the refrigerator 1 on the interface unit 92.

The dispenser 90 may include the withdrawal space 91 provided in an accommodation groove of the refrigerator compartment door 21. Here, the withdrawal space 91 may include the lever 93 manipulated by the user to discharge ice or water and configured to generate a discharge command signal when manipulated by the user, and the outlet 212 configured to discharge at least one of ice and water according to the manipulation of the lever 93. Meanwhile, at least one of ice and water is not discharged only by manipulating the lever 93, but may also be discharged by receiving a supply command through the interface unit 92.

The outlet 212 may include a first outlet 212*a* configured to discharge water and carbon dioxide to produce carbonated water and a second outlet 212*b* configured to discharge plain water or ice.

Also, as illustrated in FIG. 4, the dispenser 90 may include the accommodation space 214 configured to accommodate the carbon dioxide gas cylinder 251 in which carbon dioxide is stored, and the accommodation space 214 may include a cover configured to open and close the accommodation space 214.

Here, the carbon dioxide gas cylinder 251 may be detachably mounted in the accommodation space 214. Accordingly, the user may replace the carbon dioxide gas cylinder 251 with another cylinder when carbon dioxide in the carbon dioxide gas cylinder 251 is consumed.

Hereinafter, a control block diagram of the refrigerator will be described.

Figure 6:
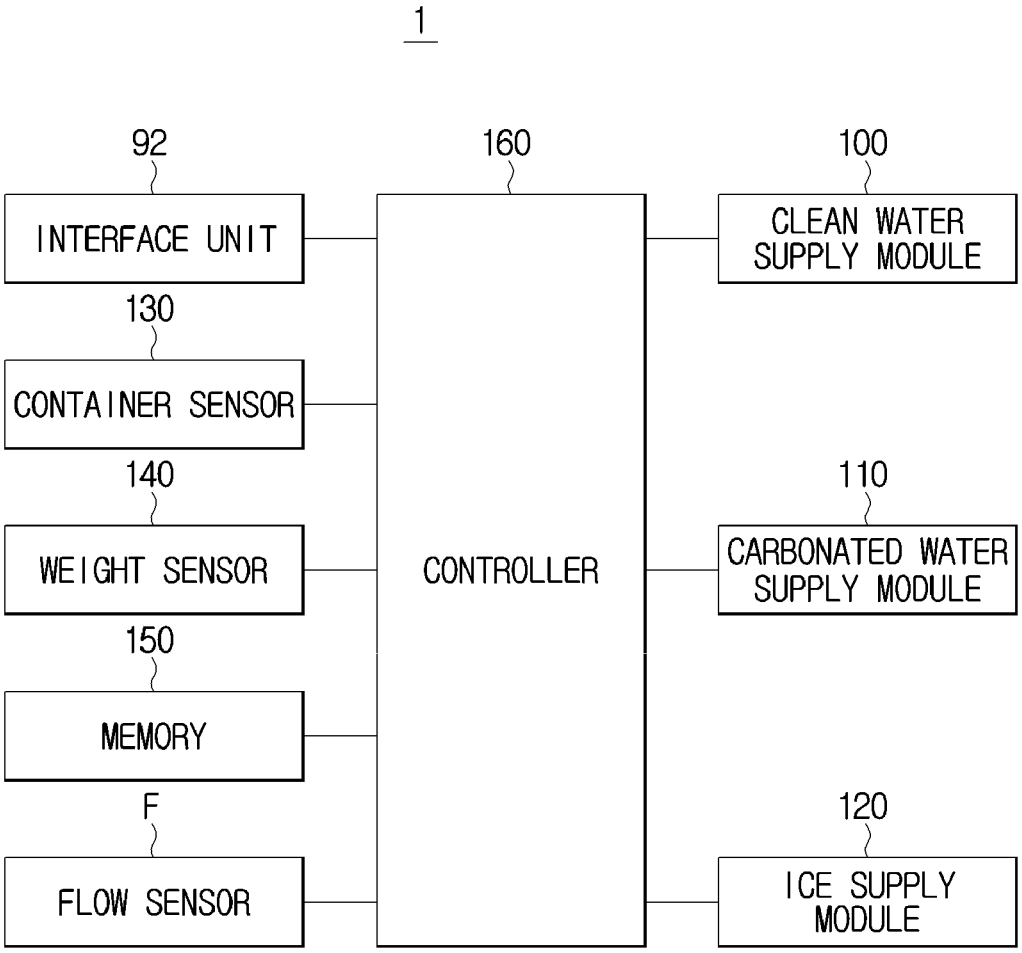
FIG. 6 is a view illustrating a control block diagram of a refrigerator that controls at least one of water and ice to be supplied in fixed amount according to an embodiment.
Figure 7:
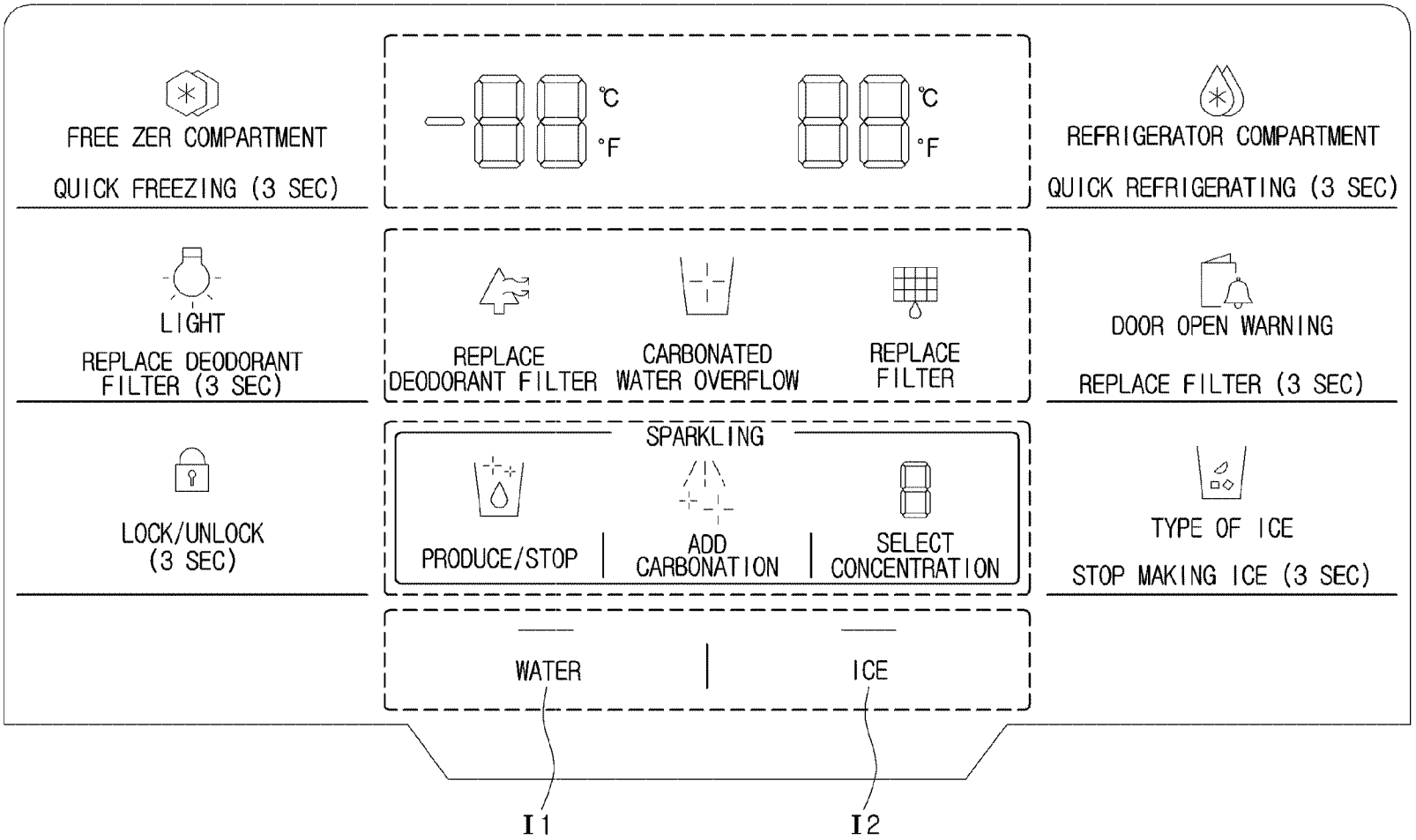
FIG. 7 is a view illustrating a user interface screen displayed on a display according to an embodiment.
Figure 8:
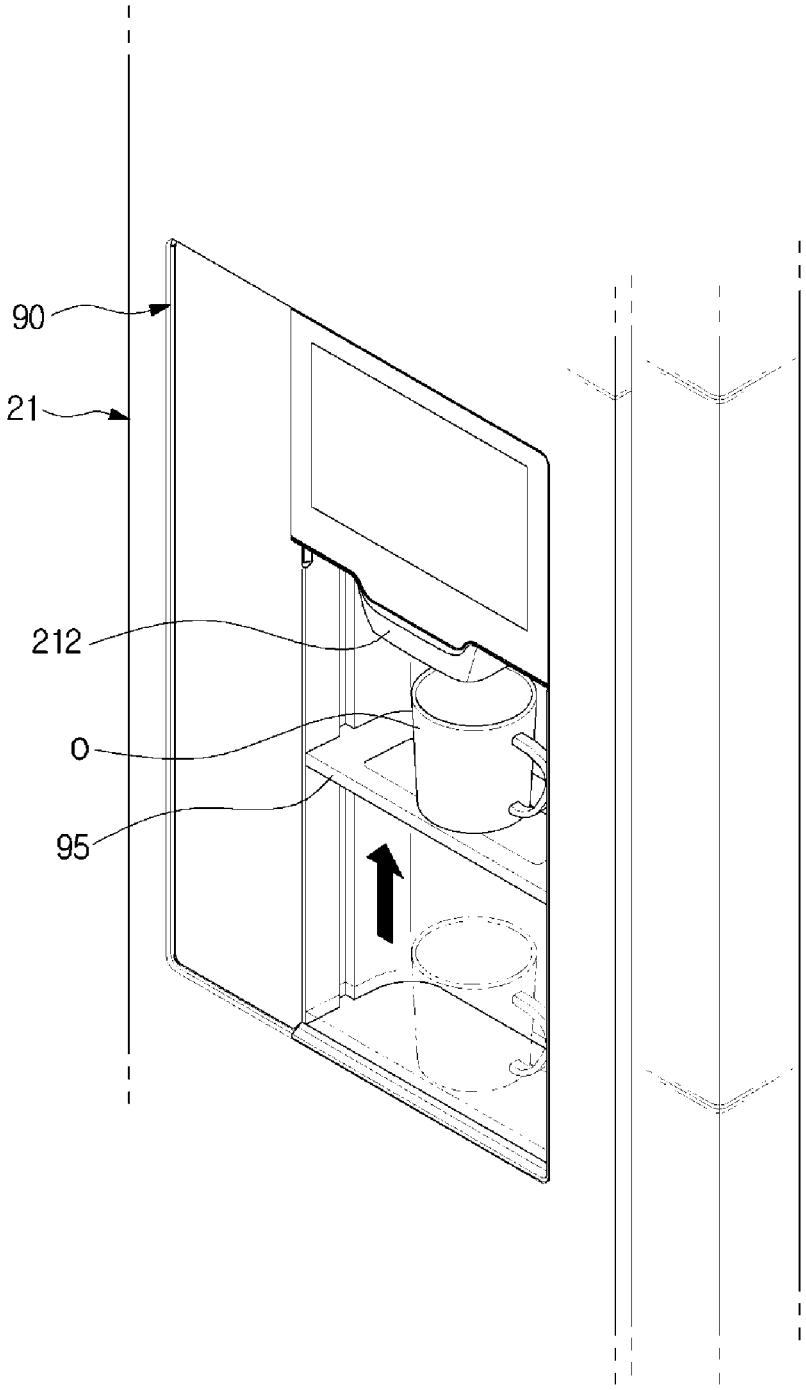
FIG. 8 is a view for describing a case in which movement of the container supporter is controlled to decrease a distance between the container and the outlet.
Figure 9A:
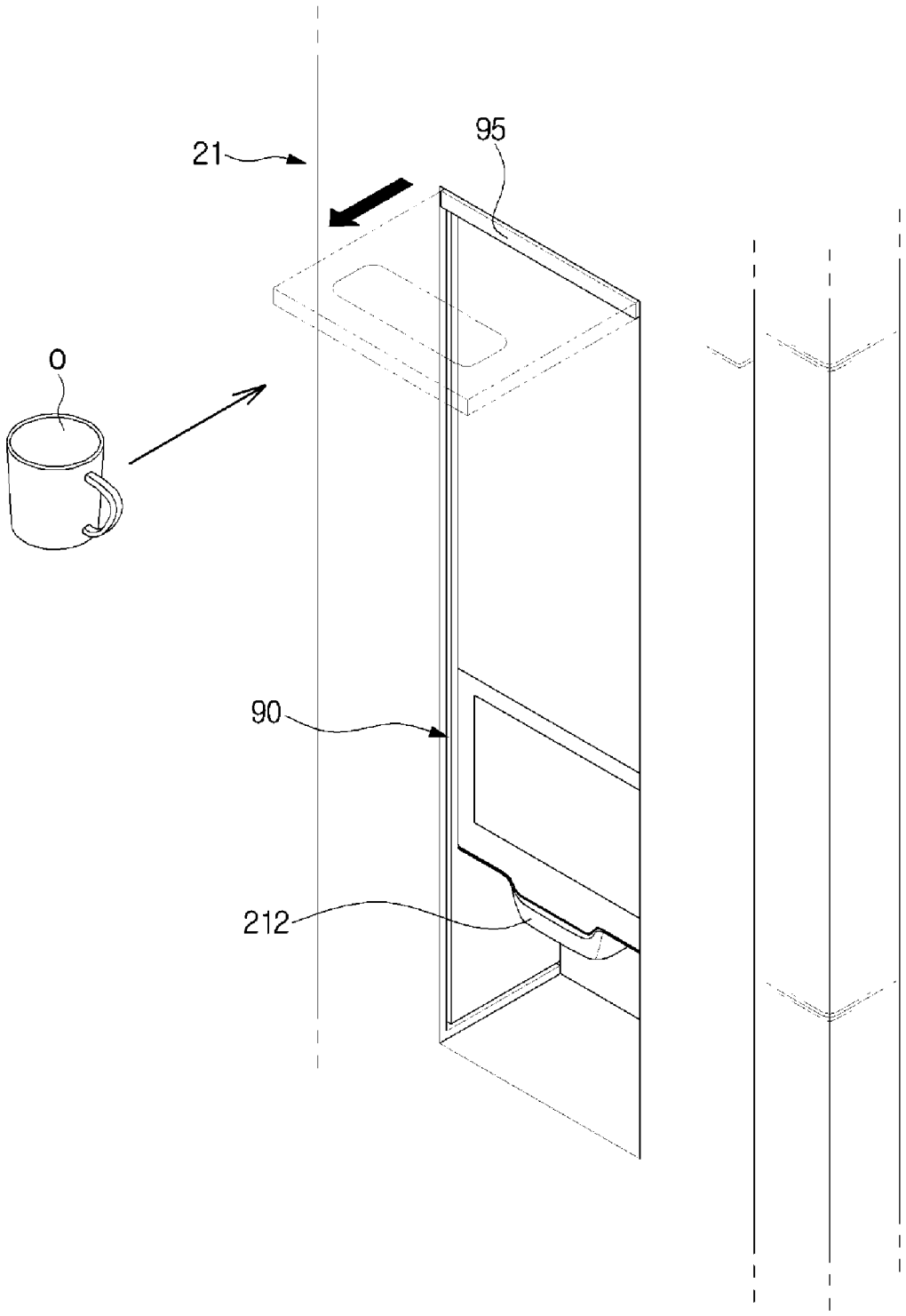
FIG. 9A is a view for describing a case in which movement of the container supporter is controlled to decrease a distance between the container and the outlet.
Figure 9B:
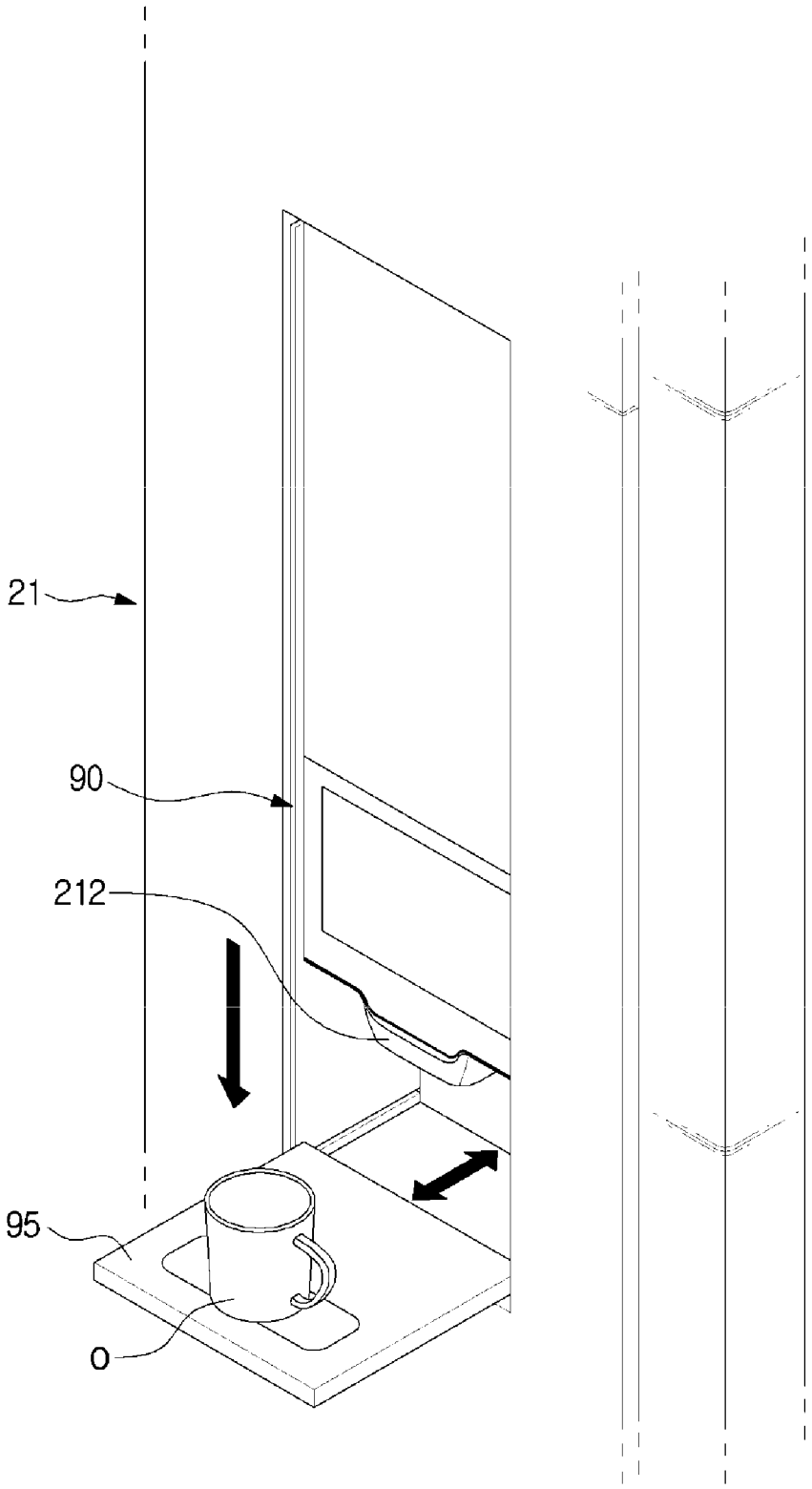
FIG. 9B is a view for describing a case in which movement of the container supporter is controlled to decrease a distance between the container and the outlet.

FIG. 6 is a view illustrating a control block diagram of a refrigerator that controls at least one of water and ice to be supplied in fixed amount according to an embodiment, FIG. 7 is a view illustrating a user interface screen displayed on a display according to an embodiment, and FIGS. 8 to 9B are views for describing a case in which movement of the container supporter is controlled to decrease a distance between the container and the outlet. Hereinafter, FIGS. 6 to 9 will be described together to prevent overlapping descriptions.

Referring to FIG. 6, the refrigerator 1 may include a clean water supply module 100, the carbonated water supply module 110, an ice supply module 120, the interface unit 92, a container sensor 130, a weight sensor 140, a memory 150, and a controller 160.

The clean water supply module 100 may supply plain water discharged through the outlet 212 of the dispenser 90 or supply clean water used in producing carbonated water. Also, the carbonated water supply module 110 may mix carbon dioxide with plain water to produce carbonated water. In addition, the ice supply module 120 may form ice through the ice maker 80 illustrated in FIG. 5 and control an operation of discharging the formed ice through the auger 84. Since the clean water supply module 100, the carbonated water supply module 110, and the ice supply module 120 have been described above, the detailed descriptions thereof will be omitted.

Meanwhile, the refrigerator 1 may include the interface unit 92 configured to perform a function of receiving various types of commands from the user and a function of visually providing various types of information to the user. Since the interface unit 92 has been generally described above, the general description thereof will be omitted.

For example, the interface unit 92 may be implemented using a display as described above, e.g., a touch screen type display, and may receive various types of control commands by the user's touching, tapping, dragging, and the like. Accordingly, the interface unit 92 may serve as an interaction medium between the user and the refrigerator 1 by performing the function of receiving various types of commands from the user as well as the function of visually providing various types of information to the user.

A user interface capable of receiving various types of commands from the user and visually providing various types of information to the user may be displayed on the interface unit 92.

Here, a user interface refers to an environment configured to facilitate controlling elements of the refrigerator 1, a program stored in the refrigerator 1, and the like and facilitate understanding various pieces of information by the user. For example, the user interface may be a graphical user interface graphically realizing a screen displayed on the interface unit 92 to facilitate an exchange of various types of information and commands between the user and the refrigerator 1.

For example, the interface unit 92 may display a user interface configured to receive information for producing carbonated water, discharging clean water, and discharging ice, and output information on producing carbonated water, information on discharging clean water, and information on discharging ice. More specifically, the user interface may include buttons, icons, or the like capable of receiving control commands related to a target temperature of the refrigerator compartment 20, a target temperature of the freezer compartment 30, whether carbonated water production is activated, a carbonated water concentration, etc. from the user and may be configured to provide information on a current temperature of the refrigerator compartment 20, a current temperature of the freezer compartment 30, whether carbonated water is being produced, and a concentration of produced carbonated water in response to the control commands from the user.

Furthermore, the user interface may include buttons, icons, or the like capable of receiving control commands related to a supply degree of water or a supply degree of ice through the dispenser 90. Here, the supply degree includes a supply amount, a supply rate, a supply level, etc. That is, the user may input the supply degree as a certain value or as a relative value.

In other words, the refrigerator 1 according to an embodiment allows the user to set a supply amount as a certain value or relatively set a supply rate or supply level depending on a container, thereby providing more convenience to the user and providing at least one of water and ice according to the supply degree set by the user. However, prior to the user setting the supply degree, a volume of at least one of water and ice that may be held by a container should be determined, and a fixed amount of at least one of water and ice should be controlled. These will be described below.

FIG. 7 is a view illustrating a user interface displayed on the display according to an embodiment. The user may tap or touch an icon on the display to input a control command. For example, when the user taps a water icon 11, the display may be switched to a user interface screen configured to allow the user to input a supply degree of water.

In another example, when the user taps an ice icon 12, the display may be switched to a user interface screen configured to allow the user to input a supply degree of ice. Then, the user may set a supply amount, a supply rate, a supply level, etc. by touching, tapping, dragging, and the like.

Data related to the user interface displayed on the interface unit 92 may be stored in the memory 150, and the controller 160 may use the data stored in the memory 150 to realize the user interface, and may display the user interface on the interface unit 92. The memory 150 and the controller 160 will be described in detail below.

Meanwhile, the refrigerator 1 may include the container sensor 130.

The container sensor 130 may detect whether a container is present and determine a height of a container. Specifically, the container sensor 130 may detect whether a container is placed on the container supporter 95 and, when a container is detected on the container supporter 95, may determine a height of the detected container.

Here, the container sensor 130 may detect whether a container is present and determine a height of a container using various sensors. According to an embodiment, the container sensor 130 may include various optical sensors such as an infrared sensor and a laser sensor, and may detect whether a container is present as well as determine a height of a container using any one of the optical sensors mentioned above.

In another example, the container sensor 130 may include a camera and a graphical processor capable of processing an image. Accordingly, the container sensor 130 may process image information acquired by the camera to detect whether a container is present as well as determine a height of a container.

The optical sensor, the camera, and the like may be mounted on positions at which a container may be detected, but positions of the optical sensor, the camera, and the like are not limited thereto. For example, the optical sensor, the camera, and the like may be mounted on one side surface of the withdrawal space 91 of the dispenser 90 to detect a container as well as determine a height of a detected container. In another example, the optical sensor, the camera, and the like may be mounted near the outlet 212 to detect whether a container is placed on the container supporter 95 as well as calculate a distance between the outlet 212 and a container and determine a height of the container based on the calculated distance.

Moreover, the container sensor 130 may include a micro-switch and at least one of the optical sensor and the camera and use these elements to detect whether a container is present as well as determine a height of a container.

For example, the container sensor 130 may detect whether a container is placed on the container supporter 95 using a micro-switch provided at the upper surface of the container supporter 95.

According to an embodiment, when pressure is received due to a container being placed on the container supporter 95, the micro-switch may output an on-signal. Conversely, when a container is not placed on the container supporter 95, the micro-switch may output an off-signal.

Accordingly, the container sensor 130 may detect whether a container is present based on a signal received from the micro-switch, and may determine a height of a container using at least one of the optical sensor and the camera as described above. The container sensor 130 may determine whether a container is placed on the container supporter 95 and a height of a container using various known methods other than above, and the methods are not limited.

Meanwhile, the refrigerator may include the weight sensor 140. The weight sensor 140 refers to a sensor configured to detect a weight of an object, convert the detected weight of the object into an electrical signal, and output the electrical signal.

The weight sensor 140 may be provided at a position at which a weight of a container and a weight of water and ice discharged into the container may be detected. For example, the weight sensor 140 may be mounted on the container supporter 95. Accordingly, the weight sensor 140 may detect a weight of a container as well as a change in weight of the container due to water and ice discharged thereto, convert the change in weight of the container into an electrical signal, and transmit the electrical signal to the controller 160.

Then, the controller 160 may more accurately determine a weight of water and ice based on the change in weight of the container, thereby more accurately determining a supply amount and enabling a fixed amount of at least one of water and ice to be controlled. This will be described in detail below.

Meanwhile, the refrigerator 1 may include the flow sensor F.

The flow sensor F may measure an amount of clean water being discharged through the water supply hose. For example, the flow sensor F may be mounted on the water supply hose as illustrated in FIG. 5 to measure a supply amount of water being discharged from the plain water tank 70.

In addition, the refrigerator 1 may include the memory 150.

Here, the memory 150 may be realized using one or more types of storage media among a flash memory type, a hard disk type, a multimedia card micro type, a card memory type (e.g., a Secure Digital (SD) card, an eXtreme Digital (XD) card, etc.), a random access memory (RAM), a static RAM (SRAM), a read-only memory (ROM), an electrically erasable programmable ROM (EEPROM), a PROM, a magnetic memory, a magnetic disk, and an optical disk. However, the memory 150 is not limited thereto and may be realized using any other form known to those of ordinary skill in the art.

Data such as various types of algorithms and programs for controlling an operation of the refrigerator 1 may be stored in the memory 150. Accordingly, the controller 160 may use the data stored in the memory 150 to control an operation of each of the elements of the refrigerator 1.

Meanwhile, data related to a volume depending on a height of a container may be stored in the memory 150. A container is present in various forms. Thus, a maximum capacity of a container varies depending on a height of the container, a diameter of the container, and a thickness of the container. Consequently, data related to a volume depending on a height of a container may be stored in the memory 150 in consideration of general or average diameter and thickness of a container. Accordingly, as will be described below, the controller 160 may use the data stored in the memory 150 to determine a volume depending on a height of a container detected by the container sensor, thereby determining the maximum capacity of the container.

Here, the maximum capacity refers to a maximum amount of at least one of water and ice that may be supplied to a container within a height of the container measured by the container sensor 130 without spilling out of the container in consideration of an average diameter and an average thickness of a container. Accordingly, as will be described below, the controller 160 may use the data stored in the memory 150 to determine the maximum capacity and control a supply of water and ice based on the determined maximum capacity.

For example, even when the user inputs that at least one of water and ice be supplied in volume exceeding the maximum capacity of a container through the interface unit 92, the controller 160 may control at least one of the clean water supply module 100, the carbonated water supply module 110, and the ice supply module 120 to supply at least one of water and ice only up to the maximum capacity of the container, thereby preventing at least one of the water and the ice from spilling.

Also, when a supply level or a supply rate is input by the user, the controller 160 may use the data stored in the memory 150 to determine the maximum capacity of the container. Then, the controller 160 may set a supply amount depending on the input supply level or supply rate based on the maximum capacity and then supply a fixed amount of water and ice corresponding to the set supply amount. Also, the controller 160 may increase convenience since supplying a fixed amount of water and ice is possible even when the user freely uses various types of containers.

Meanwhile, a method of providing various types of information through the user interface and methods of displaying and arranging icons and the like for receiving various types of settings commands and control commands may be realized using an algorithm or a program and may be stored in the memory 150. Accordingly, the controller 160 may generate a user interface using the data stored in the memory 150 and display the user interface on the interface unit 92.

Alternatively, the algorithm and the program mentioned above may be stored in an external device. Accordingly, the controller 160 may be realized to receive data related to the user interface derived by the external device using the algorithm or the program through a communications network and display the user interface on the interface unit 92, but embodiments are not limited thereto.

The data related to the user interface may be updated. For example, the data related to the user interface may be updated through a wired communications network or a wireless communications network. Consequently, the user interface displayed on the interface unit according to an embodiment is not limited to that which is illustrated in FIG. 7.

Also, the refrigerator 1 may include an overflow sensor. The overflow sensor may detect an overflow of water and ice. For example, the overflow sensor may be provided at a lower end of the dispenser 90 to detect an overflow of water and ice. According to an embodiment, the overflow sensor may be mounted on the container supporter 95. Accordingly, the controller 160 may receive a detection result from the overflow sensor and control supply of at least one of water and ice.

The refrigerator 1 may include the controller 160. Here, the controller 160 and the memory 150 may be implemented with separate chips but are not limited thereto, and may also be implemented in a single chip.

The controller 160 may be implemented using a processor such as a micro control unit (MCU). The controller 160 may control an operation of each of the elements of the refrigerator 1 using a control signal. For example, the controller 160 may control the user interface to be displayed on the interface unit 92 using a control signal and may also control an operation of each of the elements of the refrigerator 1 according to a control command input through the interface unit 92 by the user.

In another example, the controller 160 may calculate a supply amount based on a change in weight of the container on the container supporter 95 and control to supply a fixed amount of water and ice. That is, the controller 160 may set an initial weight of a container as a zero point and calculate a change in weight due to at least one of water and ice being supplied thereto as a supply amount, thereby controlling the supply of a fixed amount of water and ice in real time.

In a case of ice, a weight of ice formed in the ice maker 80 and a weight of ice that is actually discharged may differ due to various reasons. For example, a size, volume, density, etc. of ice may change due to a temperature change inside the ice maker 80. Moreover, a size, volume, density, etc. of ice may differ from initially formed ice due to coupling between pieces of ice, collision between the pieces of ice, and the like. Also, when water and ice are discharged, some of the discharged water and ice may splash or fall outside a container. The supply of a fixed amount of water and ice is possible only when a splashed or fallen amount of water and ice is subtracted from an actual supply amount.

Consequently, the controller 160 according to an embodiment may measure a change in weight of the container using the weight sensor 140 and calculate the supply amount based on the measured weight change, thereby more accurately determining the actual supply amount and enabling fixed amount control.

In addition, the controller 160 may control the supply of a fixed amount of water and ice according to a supply degree input by the user based on a height of a container detected by the container sensor 130 and a weight of the container on the container supporter 95.

As described above, when the height of the container is determined by the container sensor 130, the controller 160 may use the data stored in the memory 150 to determine the maximum capacity of the container depending on the height of the container. Accordingly, the controller 160 may set an amount of water or ice that should be supplied corresponding to a supply degree input by the user.

For example, when a supply level may be set from a first level to a fifth level, the controller 160 may control supply of water and ice to be proportional to a supply level input by the user based on the maximum capacity. According to an embodiment, when a maximum capacity determined according to a height of a container is 200 ml, and the first level is input by the user as a water supply level, the controller 160 may supply 40 ml of water. In addition, when the fifth level is input by the user as the water supply level, the controller 160 may supply 200 ml of water.

According to another embodiment, when 50% is input by the user as a supply rate, the supply amount may vary depending on the volume of the container. A 50%-supply rate in the container with a maximum capacity of 200 ml is 100 ml, and a 50%-supply rate in a container with a maximum capacity of 400 ml is 200 ml. Consequently, the controller 160 may set a supply amount depending on a supply rate based on the maximum capacity of the container determined according to the height of the container and then control supply of at least one of water and ice corresponding to the supply amount.

Meanwhile, the controller 160 may determine a supply amount of water being discharged from the plain water tank 60 using the flow sensor F. Accordingly, when water and ice are supplied together, a weight of supplied ice is obtained when a weight according to the supply amount of water is subtracted from a change in weight of a container. Consequently, the controller 160 may combine results determined by the weight sensor 140 and the flow sensor F to supply a fixed amount of water and ice.

Also, the controller 160 may stop supplying at least one of water and ice when a supply amount calculated according to a change in weight of a container is determined to have reached a supply degree of at least one of water and ice input through the interface unit 92 or the maximum capacity of the container.

For example, even if the user has directly input a supply amount of at least one of water and ice, the user would not desire water, ice, or both to overflow from the container due to being oversupplied thereto. Accordingly, the controller 160 according to an embodiment may use the data stored in the memory 150 to determine the maximum capacity of the container depending on the height of the container, and may stop supplying at least one of water or ice when it is determined that the supply amount calculated based on a change in weight of the container has reached the maximum capacity of the container. Consequently, the controller 160 according to an embodiment may prevent water or ice from overflowing due to being oversupplied.

According to an embodiment, when the user has input a total of 300 ml as a supply amount of water and ice, and a maximum capacity of a container estimated based on a height of the container is 200 ml, the controller 160 may supply water and ice only up to 200 ml. According to another embodiment, when an overflow of water or ice is detected by the overflow sensor, the controller 160 may stop supplying water or ice.

Meanwhile, the container supporter 95 may be fixed to a particular position or vertically and horizontally movable as described above. For example, the container supporter 95 may include a motor. Here, the controller 160 may control an operation of the motor using a control signal to control movement of the container supporter 95.

When the container and the outlet are spaced apart by a predetermined distance or more, water and ice discharged into a container may splash or fall out of the container. To prevent this, the controller 160 according to an embodiment may calculate a distance between the container and the outlet based on a height of the container measured by the container sensor 130. Then, the container 160 may control movement of the container supporter 95 so that the container and the outlet are spaced apart within the predetermined distance. Here, the predetermined distance may be preset when designing the refrigerator or may be directly set by the user. Information on the predetermined distance may be stored in the memory 150.

FIGS. 8 to 9B are views for describing a case in which movement of the container supporter is controlled to decrease a distance between the container and the outlet.

Referring to FIG. 8, the controller 160 may move the container supporter 95 upward using a control signal so that the outlet 212 and a container O are spaced apart within a predetermined distance.

Meanwhile, the container supporter 95 is not always disposed below the outlet 212. For example, as illustrated in FIG. 9A, the container supporter 95 may be provided above the outlet 212. In this case, due to the dispenser 90 provided at a lower portion of the refrigerator 1, there is an advantage in that a space of an area frequently used by the user can be better secured.

Here, when a command for supplying at least one of water and ice is input by the user through the interface unit 92, the controller 160 may control the container supporter 95 to come out of an inner portion of the refrigerator compartment door 21 using a control signal.

When the user puts the container O on the container supporter 95, the container sensor 130 may detect the container as described above. Accordingly, when it is detected that the container is placed on the container supporter 95, the controller 160 may move the container supporter 95 downward as illustrated in FIG. 9B to control the outlet 212 and the container O to be spaced apart within the predetermined distance.

Also, the controller 160 may fix the container O placed on the container supporter 95 using a control signal. For example, the container supporter 95 may be implemented as an elastic member, and a groove in which the container may be placed may be provided at the upper surface of the container supporter 95.

Accordingly, when the container sensor 130 detects that the container O is placed on the container supporter 95, the controller 160 may control the operation of the motor using a control signal to adjust a size of the groove on the container supporter 95, thereby fixing the container O.

Meanwhile, the controller 160 may control at least one of the clean water supply module 100, the carbonated water supply module 110, and the ice supply module 120 using a control signal to control an order in which water and ice are supplied. For example, when ice is supplied after water, water in the container may splash. Consequently, the controller 160 according to an embodiment may control at least one of the clean water supply module 100, the carbonated water supply module 110, and the ice supply module 120 using a control signal so that ice is supplied before water.

Hereinafter, an operational flow of a refrigerator supplying a fixed amount of water and ice will be described.

Figure 10:
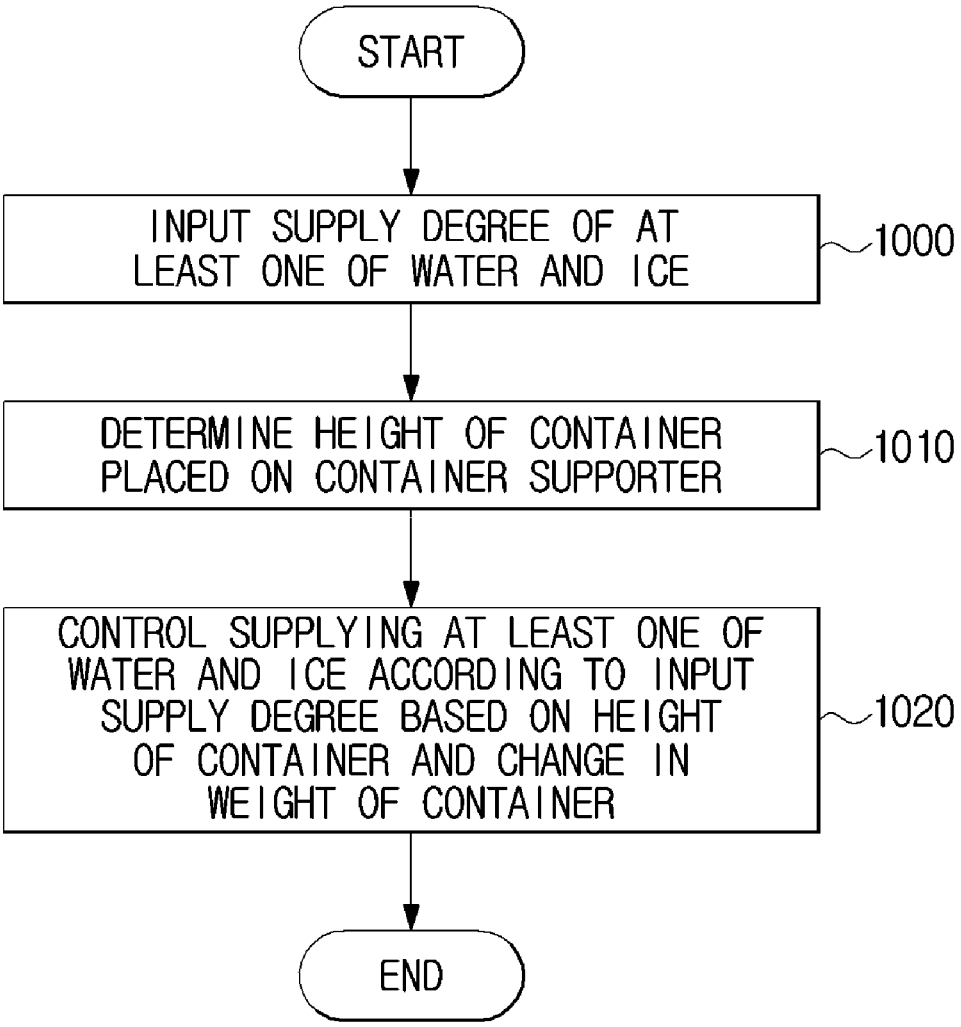
FIG. 10 is a view illustrating an operational flow of a refrigerator controlling a supply of a fixed amount of at least one of water and ice according to an embodiment.

FIG. 10 is a view illustrating an operational flow of a refrigerator controlling a supply of a fixed amount of at least one of water and ice according to an embodiment.

Referring to FIG. 10, the refrigerator may receive various types of control commands related to the refrigerator from a user. Here, the various types of control commands related to the refrigerator are control commands related to each of the elements of the refrigerator and include a command for supplying water or ice through the dispenser.

For example, the refrigerator may receive a command for supplying at least one of water and ice from the user through the interface unit. Then, the refrigerator may detect whether a container is placed on the container supporter through the container sensor.

When it is detected that a container is placed on the container supporter, the refrigerator may determine a height of a container. It is necessary to set a volume of the container to determine the maximum capacity of the container. Accordingly, data related to average volumes of containers according to a height of the container may be stored in the memory of the refrigerator according to an embodiment.

For example, a database related to average volumes of containers according to a height of the container may be stored in the memory. Then, the refrigerator may search for a volume according to a height of a container detected by the container sensor from the database and determine the maximum capacity based on the volume. Accordingly, the refrigerator according to an embodiment may determine whether a supply amount input by the user exceeds the maximum capacity and control supply of at least one of water and ice based on a determined result.

For example, the refrigerator may detect a weight of the container using the weight sensor before at least one of water and ice is supplied to the container. The refrigerator may measure a change in weight of the container due to the at least one of water and ice being supplied to the container using the weight sensor based on the weight of the container before the at least one of water and ice is supplied thereto.

Here, the change in weight of the container refers to a supply amount of the at least one of water and ice. That is, the refrigerator may set the weight of the container before the at least one of water and ice is supplied thereto as a zero point using the weight sensor and may calculate the change in weight of the container as a supply amount based on the set zero point.

For example, the refrigerator may calculate a supply amount of water using the flow sensor. In this case, a weight according to a supply amount of ice is obtained when a weight according to the supply amount of water is subtracted from the change in weight of the container measured based on the zero point. Accordingly, even when a form, volume, weight, etc. of ice stored in the ice bucket changes, the refrigerator may accurately calculate the supply amount of ice, thereby supplying a fixed amount of ice.

Also, the user may differently set a supply degree of water and a supply degree of ice. Here, the refrigerator may separately calculate a supply amount of water and a supply amount of ice using the flow sensor and the weight sensor, thereby supplying a fixed amount of water and ice.

Embodiments disclosed herein and elements illustrated in the drawings are merely exemplary embodiments of the present disclosure, and various modified embodiments that may substitute for the embodiments and the drawings of the present disclosure may be present at the time of applying the present application.

Also, terms used herein are used to describe the embodiments and are not intended to limit and/or restrict the present disclosure. A singular expression includes a plural expression unless the context clearly indicates otherwise. In the present disclosure, terms such as "include" or "have" should be understood as designating that features, number, steps, operations, elements, parts, or combinations thereof exist, and not as precluding the existence of or the possibility of adding one or more other features, numbers, steps, operations, elements, parts, or combinations thereof.

Also, terms including ordinals such as "first," "second," etc. may be used to describe various elements, but the elements are not limited by the terms. The terms are only used for the purpose of distinguishing one element from another element. For example, a first element may be referred to as a second element while not departing from the scope of the present disclosure, and likewise, a second element may also be referred to as a first element. The term "and/or" includes a combination of a plurality of related described items or any one item among the plurality of related described items.

Also, terms such as "unit," "-er," "block," "member," and "module" may refer to a unit of processing at least one function or operation, e.g. software or hardware such as FPGA and ASIC. However, meanings of the terms such as "unit," "-er," "block," "member," and "module" are not limited to software or hardware and may be an element stored in an accessible storage medium and executed by one or more processors.

Embodiments of the present disclosure have been described above to assist in an understanding of the present disclosure. However, as should be recognized by those or ordinary skill in the art, the present disclosure is not limited by the particular embodiments described herein but may be modified, changed, and substituted in various ways within a scope that does not depart from the scope of the present disclosure.

What is claimed is:

1. A refrigerator comprising:

an interface configured to:

receive a command for supplying at least one of water and ice from a user, and receive a supply degree related to the at least one of water and ice as a percentage of a determined maximum capacity of a container placed on the refrigerator to receive the at least one of water and ice;

a weight sensor configured to measure a weight of the container while the container is placed on a container supporter; and a controller configured to:

calculate a supplied amount of the at least one of water and ice based on a change in the measured weight of the container due to the at least one of water and ice being supplied to the container, and control a supply of the at least one of water and ice based on the calculated supplied amount, the received supply degree, and the determined maximum capacity of the container.

2. The refrigerator of claim 1, further comprising a container sensor configured to determine a height of the container while the container is placed on the container supporter.

3. The refrigerator of claim 2, further comprising a memory configured to store data related to a volume corresponding to the height of the container, among data of volumes depending on heights of containers, respectively.

4. The refrigerator of claim 3, wherein the controller is further configured to use the data related to the volume stored in the memory to determine the maximum capacity of the container according to the determined height of the container.

5. The refrigerator of claim 4, further comprising:

a flow sensor configured to measure a supplied amount of water being supplied, wherein the controller is further configured to:

when water and ice are supplied together, obtain a weight of supplied ice by subtracting a weight corresponding to the measured supplied amount of the water from the change in the weight of the container, and, to control the supply of the at least one of water and ice, control the supply of the water and the supply of the ice, respectively, according to the obtained weight of the supplied ice and the measured supplied amount of the water.

6. The refrigerator of claim 1, wherein the controller is further configured to stop the supply of the at least one of water and ice when the calculated supplied amount is equal to the received supply degree or is equal to the maximum capacity.

7. The refrigerator of claim 1, wherein the controller is further configured to control ice to be supplied first when water and the ice are supplied together.

8. The refrigerator of claim 2, wherein the container sensor is further configured to detect whether the container is placed on the container supporter by using at least one of an optical sensor, a camera, and a micro-switch, and determine the height of the container placed on the container supporter when the container is detected on the container supporter.

9. The refrigerator of claim 1, further comprising:

a container sensor configured to determine a height of the container while the container is placed on the container supporter, wherein the controller is further configured to:

calculate a distance between the container and an outlet based on the determined height of the container, the outlet being configured to discharge the at least one of water and ice, and when the calculated distance is greater than a predetermined distance, control a movement of the container supporter so that the outlet and the container are spaced apart within the predetermined distance.

10. The refrigerator of claim 1, further comprising:

an overflow sensor configured to detect whether the at least one of water and ice overflows from the container, wherein the controller is further configured to control the supply of at least one of water and ice to stop when the overflow sensor detects that the at least one of water and ice overflows from the container.

11. A method of controlling a refrigerator, the method comprising:

receiving through an interface, a command for supplying at least one of water and ice;

receiving through the interface, a supply degree related to the at least one of water and ice as a percentage of a determined maximum capacity of a container placed on the refrigerator to receive the at least one of water and ice;

measuring, by a weight sensor, a weight of the container while the container is placed on a container supporter;

calculating, by a controller, a supplied amount of the at least one of water and ice based on a change in the measured weight of the container due to the at least one of water and ice being supplied to the container; and controlling, by the controller, a supply of the at least one of water and ice based on the calculated supplied amount, the received supply degree, and the determined maximum capacity of the container.

12. The method of claim 11, wherein the controlling further includes determining a height of the container while the container is placed on the container supporter.

13. The method of claim 12, wherein the controlling further includes determining the maximum capacity of the container according to the determined height of the container by using data related to a volume corresponding to the determined height of the containers stored in a memory, among data of volumes depending on heights of containers, respectively.

14. The method of claim 13, further comprising:

measuring, by a flow sensor, a supplied amount of water being supplied;

wherein the controlling includes:

when water and ice are supplied together, obtaining a weight of supplied ice by subtracting a weight corresponding to the measured supplied amount of the water from the change in the weight of the container, and, to control the supply of the at least one of water and ice, controlling the supply of the water and the supply of the ice, respectively, according to the obtained weight of the supplied ice and the measured supplied amount of the water.

15. The method of claim 14, wherein the controlling further includes stopping the supply of the at least one of water and ice when the calculated supplied amount is equal to the received supply degree or is equal to the maximum capacity.

16. The method of claim 13, wherein the controlling further includes controlling ice to be supplied first when water and the ice are supplied together.

17. The method of claim 13, further comprising:

determining, by a container sensor, a height of the container while the container is placed on the container supporter, wherein the controlling further includes:

calculating a distance between the container and an outlet based on the determined height of the container, the outlet being configured to discharge the at least one of water and ice, and when the calculated distance is greater than a predetermined distance, controlling a movement of the container supporter so that the outlet and the container are spaced apart within the predetermined distance.

18. The method of claim 11, further comprising:

sensing, by an overflow sensor, whether the at least one of water and ice overflows from the container, wherein the controlling includes controlling the supply to stop when the overflow sensor detects that the at least one of water and ice overflows from the container.

19. The method of claim 11, further comprising:

controlling a movement of the container supporter so that a top of the container and an outlet for supplying the at least one of water and ice are spaced apart a predetermined distance.

* * * * *